United States Patent [19]

Satomura

[11] 4,245,857

[45] Jan. 20, 1981

[54] RECORDING ELEMENT

[75] Inventor: Masato Satomura, Fujinomiya, Japan

[73] Assignee: Fuji Photo Film Co., Ltd., Ashigara, Japan

[21] Appl. No.: 971,149

[22] Filed: Dec. 19, 1978

[30] Foreign Application Priority Data

Dec. 27, 1977 [JP] Japan ..... 52-159548

[51] Int. Cl.[3] ..... B41M 5/22

[52] U.S. Cl. ..... 282/27.5; 106/21; 427/150; 427/151; 428/307; 428/914

[58] Field of Search ..... 282/27.5; 427/150, 151; 428/307, 411, 913, 914, 537; 106/21; 252/316

[56] References Cited

U.S. PATENT DOCUMENTS

| | | | |
|---|---|---|---|
| 4,012,554 | 3/1977 | Miller et al. | 282/27.5 |
| 4,021,595 | 5/1977 | Kiritani et al. | 282/27.5 |
| 4,087,284 | 5/1978 | Golden et al. | 282/27.5 |
| 4,101,690 | 7/1978 | Miyamoto et al. | 282/27.5 |

*Primary Examiner*—Bruce H. Hess

*Attorney, Agent, or Firm*—Sughrue, Rothwell, Mion, Zinn and Macpeak

[57] ABSTRACT

Recording elements of the type which form color upon contact with a color developer such as acid clay and are provided with microcapsules are disclosed having incorporated therein alcohols or ketones having at least 6 carbon atoms. Coloring speed of the recording elements are superior while maintaining high color developability.

10 Claims, No Drawings

RECORDING ELEMENT

BACKGROUND OF THE INVENTION

1. Field of the Invention

The present invention relates to recording elements and, more particularly, to a recording element having excellent coloring speed.

2. Brief Description of the Invention

Recording elements relying on a substantially colorless color former which is brought into contact with an acidic substance (the color developer) to produce color are already well known. Representative examples are pressure-sensitive copying paper, heat-sensitive recording sheets, electric current-applying recording sheets and the like, which are described in detail in U.S. Pat. Nos. 2,712,507, 2,730,456, 2,730,457, 3,418,250, 3,432,327, 3,981,821, 3,993,831, 3,996,156, 3,996,405, 4,000,087, etc.

The color developers used in these recording elements are clay minerals such as acidic clay, bentonite, kaolin, etc., organic acids or salts thereof such as isopropenylphenol dimer, novolak, metal-treated novolak, di-tertbutylsalicylic acid, di-α-methylbenzylsalicylic acid zinc salt, etc.

The color formers in these elements are compounds that are usually substantially colorless and possess a partial structure such as a lactone, lactam, sultone, spiropyran, esters, amides, etc., and are brought into contact with color developers, whereby these partial structures are opened or cleaved. Specifically, these compounds are exemplified by crystal violet lactone, benzoyl leucomethylene blue, marachite green lactone, rhodamine B lactam, 1,3,3-trimethyl-6′-ethyl-8′-butoxyindolinobenzospiropyran, etc.

These color developers and color formers are occasionally employed in combinations of two or more thereof depending upon utility. The color formers are dispersed or dissolved in a solvent and microencapsulated in order to be stably stored until they are employed in recording elements.

In general, aromatic compounds such as hydrogenated terphenyl, alkylated diphenyl alkanes, alkylated triphenyl dimethane, etc., aliphatic compounds such as kerosine, chlorinated paraffin, cotton seed oil, etc., are employed as solvents. For these solvents, the properties have been hitherto required such that (1) the solubility of color formers therein is excellent and (2) the coloring density is high, etc.

Further, organic acids or salts thereof have been investigated as color developers since the stability of colored images with the passage of time, humidity resistance and so on is superior. In the case of using organic acids or metal compounds thereof, however, the image density immediately after color formation is poor. The present invention is directed to overcoming this disadvantage.

SUMMARY OF THE INVENTION

An object of the present invention is to provide a recording element in which coloring speed is markedly improved.

Another object of this invention is to improve the coloring speed of a recording element wherein the color developer is an organic acid or salt thereof.

This and other objects of the present invention are accomplished by incorporating into the microcapsule containing the color former alcohols or ketones having at least 6 carbon atoms.

DETAILED DESCRIPTION OF THE INVENTION

The alcohols or ketones which can be employed in accordance with the present invention are those having at least 6 carbon atoms. With alcohols or ketones having less than 5 carbon atoms, the object of the present invention can not be attained. A suitable upper limit on the carbon atom number is approximately 20. The alcohols or ketones having 7 to 16 carbon atoms are preferred.

Of the alcohols and ketones used in the present invention, the aliphatic ones are preferred. In this case, the aliphatic residues can be straight chain, branched chain or cyclic; further, they can be saturated or unsaturated. In addition, of those alcohols and ketones employed in accordance with the present invention, those having a solubility in water (expressed as grams of solute per 100 grams of water at 25° C.) of less than about 2, particularly less than 1, are preferred in view of the effect on coloring speed.

Representative examples of the alcohols and ketones which are employed in accordance with the present invention include heptanol, octanol, nonanol, decanol, dodecanol, heptanone, octanone, nonanone, decanone, tridecanol, tridecanone-2,3-undecylenyl-1-ol, 3-ethylcyclohexylmethanol and the like.

The amounts of the alcohols or ketones which are used in the present invention should be appropriately adjusted; if the amount is too small, the effect is insufficient and, on the other hand, if the amount is excessive, color formers are precipitated which can render encapsulation difficult. Accordingly, though the addition amount varies depending upon color former employed, the properties of the solvent for the color formers, and the like, it is generally appropriate that the amount be in a range of about 5 to about 50 wt%, preferably about 10 to about 30 wt%, based on the solvent for the color former.

The present invention is characterized by incorporating into the microcapsules the aforesaid specific alcohols or ketones. In view of the prior knowledge that alcohols have hitherto been used as desensitizers in the color former-color developer system, and the fact the effect of improving coloring speed is not observed with lower alcohols or ketones such as butanol or methyl ethyl ketone, and that the alcohols or ketones employed in the present invention have a rather poor influence on the solubility of the color formers, it is quite unexpected and extremely surprising that the coloring speed can be improved markedly by using these specific alcohols or ketones.

The recording element in accordance with the present invention is characterized by improved coloring speed. This characteristic is extremely remarkable where organic acids are employed as color developers. Therefore, a preferred embodiment of the present invention is a recording element comprising a combination of a color former system comprising microcapsules containing a color former and alcohols or ketones having at least 6 carbon atoms and a color developer system comprising an organic acid.

Hereafter, components employed in the recording element of the present invention and the production of the recording element are described in detail.

In the present invention, the organic acids which are employed as color developers include organic compounds having acidic groups. That is, compounds having at least one acidic group such as carboxyl group, a thiocarboxyl group, phenolic hydroxyl group, a mercapto group, a sulfo group, etc., or their salts (in particular, polyvalent metal salts). These compounds can also be polymers (e.g., a polycondensate of the acids described below and an aldehyde compound).

Specific examples of these color developers include acids derived from phenol, butylphenol, octylphenol, salicylic acid, phenylphenol, isopropenylphenol dimer, etc., novolak resins thereof and metal salts thereof. Practical examples of the acids are 3,5-di(α-methylbenzyl)salicylic acid, 3-(α-methylbenzyl)-5-(α,α-dimethylbenzyl)salicylic acid, 3-(4'-α',α'-dimethylbenzyl)phenyl-5-(α,α-dimethylbenzyl)salicylic acid, 3-cyclohexyl-5-(α,α-dimethylbenzyl)salicylic acid, 3-phenyl-5-(α,α-dimethylbenzyl)salicylic acid, 3,5-di-(α,α-dimethylbenzyl)salicylic acid, etc.

Examples of the particularly preferred compounds of the above-described compounds are 3,5-di(α-methylbenzyl)salicylic acid, 3-(α-methylbenzyl)-5-(α,α-dimethylbenzyl)salicylic acid, 3-(4'-α',α'-dimethylbenzyl)-phenyl-5-(α,α-dimethylbenzyl)salicylic acid, 3,5-di-t-butylsalicylic acid, 3,5-di-t-octylsalicylic acid, 3-cyclohexyl-5-(α,α-dimethylbenzyl)salicylic acid, 3-phenyl-5-(α,α-dimethylbenzyl)salicylic acid, 3,5-di(α,α-dimethylbenzyl)salicylic acid, and 3,5-dicyclohexylsalicylic acid.

As the polyvalent metals for making the metal salts of the above aromatic carboxylic acids, there are magnesium, aluminum, calcium, scandium, titanium, vanadium, chromium, manganese, iron, cobalt, nickel, copper, zinc, gallium, germanium, strontium, yttrium, zirconium, molybdenum, silver, cadmium, indium, tin, antimony, barium, tungsten, lead, bismuth, etc. Particularly effective metals are zinc, tin, aluminum, magnesium, and calcium. Furthermore, the most effective metal among these metals is zinc.

These metal salts can be employed after previously converting into metal salts, alternatively, they can be employed in the form of forming metal salts after coating and drying. The above organic compounds can be used simultaneously with a developing agent such as acid clay and active clay, and a pigment such as calcium carbonate, zinc oxide, aluminum hydroxide and lithopone.

The color formers include compounds that when brought into contact with the organic acids give an absorption at a visible region. The color formers possess a partial structure, such as lactone, lactam, sultone, spiropyran, ester, amide, etc., and are generally almost colorless compounds. Specifically, the color formers are triarylmethane type compounds, diphenylmethane type compounds, xanthene type compounds, thiazine type compounds, spiropyran type compounds, etc.; specific examples thereof are crystal violet lactone, benzoyl leucomethylene blue, marachite green lactone, p-nitrobenzoyl leucomethylene blue, 3-dialkylamino-7-dialkylaminofluoranes, 3-methyl-2,2'-spirobi(benzo-f-chromene), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, 4,4'-bis-dimethylaminobenzhydrinebenzyl ether, N-halophenyl leuco auramines, N-2,4,5-trichlorophenyl leuco auramine, rhodamine B anilino lactam, rhodamine (p-nitroanilino)lactam, rhodamine B (p-chloroanilino)lactam, 3-dimethylamino-6-methoxyfluorane, 3-diethylamino-7-methoxyfluorane, 3-diethylamino-7-chloro-6-methylfluorane, 3-diethylamino-7-(acetylmethylamino)fluorane, 3-diethylamino-7-(dibenzylamino)-fluorane, 3-diethylamino-7-(methylbenzylamino)fluorane, 3-diethylamino-7-(chloroethyl-methylamino)fluorane, 3-diethylamino-7-(diethylamino)fluorane, 3-methyl-spirodinaphthopyran, 3-ethyl-spirodinaphthopyran, 3,3'-dichloro-spirodinaphthopyran, 3-benzyl-spirodinaphthopyran, 3-methylnaphtho(3-methoxybenzo)-spiropyran, 3-propylspirodibenzodipyran, etc.

These color formers are employed singly or in combination thereof.

Upon encapsulation, solvents which dissolve these color formers therein are chosen from those that dissolve color formers in an amount of at least 5 wt%, particularly about 10 wt% or more, of crystal violet lactone. The solubility of 5 wt% herein refers to an amount of a single color former or a plurality of color formers dissolved at 23° C. The solvent, which, when used in a solution, does not give any precipitate after allowing the solution to stand for about 3 days at 23° C. is suitable.

Specifically, there are aliphatic compounds and aromatic compounds suitable as solvents. For example, chlorinated paraffin (chlorination degree of about 15 to about 60), alkyl or aralkyl benzenes or naphthalenes (having not greater than about 5 carbon atoms in the alkyl group), e.g., triphenylmethane, diphenyltolylmethane, xylylphenylethane, benzylxylene, α-methylbenzyltoluene, diisopropylnaphthalene, isobutylbiphenyl, tetrahydronaphthalene, hydrogenated terphenyl, di-α-methylbenzyl, xylene, tert-butyl diphenyl ether, styrene dimer, etc. These solvents may be employed singly or in combination of two or more kinds.

The color former which is dissolved in at least one of the aforesaid solvents is encapsulated. For example, processes for preparing microcapsules include coacervation disclosed in U.S. Pat. Nos. 2,800,457 and 2,800,458; interfacial polymerization disclosed in British Pat. No. 990,443 and U.S. Pat. No. 3,287,154; precipitation of polymers as disclosed in U.S. Pat. Nos. 3,418,250 and 3,660,304, and Japanese Patent Publication No. 23165/1972; a polymerization method for reactants from the inside of oil droplets as disclosed in U.S. Pat. Nos. 3,726,804 and 3,796,669, etc., are advantageous from the standpoint of rendering a high concentration fine oil droplets.

In accordance with these methods, capsules having an average capsule size of smaller than about 10 microns and larger than about 2 microns (volume average capsule size) are formed.

The thus-obtained color former-containing capsules are coated onto the surface opposite the color developer layer or the same surface to give a recording element for copying.

A variety of additives, binders, antioxidants, smudge preventing agents, surface active agents, coating methods, method for using such additives, etc., upon providing a capsule layer by coating are well known in U.S.

Pat. Nos. 2,711,375 and 3,625,736, British Pat. No. 1,232,347, Japanese Patent Application (OPI) Nos. 44012/1975 (The term "OPI" as used herein refers to a "published unexamined Japanese patent application"), 50112/1975, 127718/1975 and 30615/1975, U.S. Pat. Nos. 3,836,383 and 3,846,331, etc.

The color former is employed in an amount of about 0.03 to about 0.5 g/m$^2$, and the color developer is employed in an amount of about 0.1 to about 2 g/m$^2$. In addition, the color former is employed in an amount of about 3 wt% to about 40 wt% based on the primary solvent described above.

Further, where the color developer layer is provided by coating, if the aforesaid organic acid derivatives or polyvalent metal salts thereof and metal compounds, particularly polyvalent metal salts (e.g., oxides, hydroxides, carbonates, acetates or phosphates of zinc, aluminum, barium, calcium, silicon, etc., or talc, clay, etc.), are employed in an amount of about 1 to about 300 parts by weight to 10 parts of the color developer, there is an advantage that color developability is maintained over a long period of time (stability is increased with the passage of time), even if these color developers per se do not possess color developing ability. These compounds are coated onto a paper sheet in a state where the compounds are dispersed or dissolved in organic solvents or water. In this process, if necessary, a latex, water-soluble polymers such as carboxy-modified styrene-butadiene copolymer, butadiene-butyl acrylate-styrene-maleic acid copolymer, vinyl acetate-styrene-methyl methacrylate copolymer, isoprene-maleic acid-acrylonitrile copolymer, petroleum resins, oxidized starch, polyvinyl alcohol, methyl cellulose, etc., can be employed. Dispersing agents, stabilizers and the like may be incorporated into these dispersions or solutions, which are coated in accordance with the coating methods as described in the aforesaid patents or applications, e.g., a dip coating, an air knife coating, a blade coating, a roller bead coating, a curtain coating, a gravure coating, etc. Ordinary sized paper is employed as a paper sheet.

In the present invention, the color developer layer is preferably smooth, and for this reason, is generally once compressed by means of calendering to smoothen.

The present invention will be further explained in detail by referring to the examples hereinbelow. In the examples, the coloring speed is expressed using a coloring speed coefficient. Herein, the coloring speed coefficient is a ratio ($D_2/D_1$) of density ($D_1$), 1 hour after the color formation, to density ($D_2$) immediately after the coler formation (15 seconds after the color formation), at 610 mμ. From a practical standpoint, it is preferred that the coloring speed coefficient be at least 0.65, more preferably at least 0.70, most preferably at least 0.80. With the coloring speed coefficient of smaller than 0.65, the density immediately after color formation is poor, which is not preferred.

EXAMPLE 1

A color developer layer was prepared as follows.

A 25 wt% dispersion of a solid component consisting of 90 parts of talc, 1.0 part of naphthalenesulfonic acid-formalin condensate, 12 parts of zinc oxide, 9.5 parts of zinc di-α-methylbenzylsalicylate, 3 parts of oxidized starch, 5.5 parts of polyvinyl alcohol, and 9 parts of carboxy-modified styrene-butadiene latex was prepared using an attliter. The dispersion was coated onto one surface of a paper sheet of weight of 40 g/m$^2$ in an amount of 0.33 g/m$^2$ (calculated as zinc di-α-methylbenzylsalicylate).

Onto the back surface thereof, a microcapsule layer was provided by coating. A microcapsule dispersion was prepared in accordance with Example 2 of Japanese Patent Publication No. 10427/1977. The color former was a 3:1 mixture of crystal violet lactone and benzoyl leucomethylene blue. The solvent or 1-xylyl-1-phenylethane was employed. The color former mixture was dissolved in the solvent in an amount of 5.4 wt% and Compound 1 or 2 of the present invention was further added thereto in an amount of 10 vol%.

Compound 1: methyl hexyl ketone

Compound 2: n-octanol

To the so obtained capsule dispersion, cellulose floc and starch particles were added in a ratio of 2:1 in an amount of 1.2 times that of the solid component. The dispersion was coated so as to provide 0.085 g/m$^2$ color former.

To the thus-prepared recording element was applied pressure of 200 kg/cm$^2$ in a fixed manner and the coloring speed coefficient was measured. The results are shown in Table 1 below.

TABLE 1

| Compound | None | 1 | 2 |
|---|---|---|---|
| Coloring speed coefficient | 0.60 | 0.78 | 0.82 |

As is clear from the results shown in Table 1, the coloring speed was markedly improved in the recording element using the compounds of the present invention. In addition, no desensitization effect was noted and high color developability was exhibited. It is quite unexpected that coloring speed alone is specifically improved while maintaining the color developability in a high value.

EXAMPLE 2

As shown in Table 2 below, the coloring speed coefficient was measured in a manner similar to Example 1, using the compounds of the present invention and a compound which does not fall in the scope of the present invention. The results obtained are shown in Table 2 below.

TABLE 2

| Compound | Amyl Alcohol | Decyl Alcohol | Dodecyl Alcohol | Methyl Isopropyl Ketone |
|---|---|---|---|---|
| Coloring speed coefficient | 0.60 | 0.75 | 0.70 | 0.60 |

It is clearly understood from the results shown in Table 2 that the alcohols or ketones having at least 6 carbon atoms in accordance with the present invention exhibit excellent effect of improving coloring speed; whereas amyl alcohol (having 5 carbon atoms) or methyl isopropyl ketone (having 5 carbon atoms) are ineffective.

While the invention has been described in detail and with reference to specific embodiments thereof, it will be apparent to one skilled in the art that various changes and modifications can be made therein without departing from the spirit and scope thereof.

What is claimed is:

1. A recording element comprising a support having provided thereon microcapsules the contents of which consist essentially of: (a) a color former capable of forming a color on contact with a color developer; (b) a solvent for the color former other than an alcohol or ketone, each having at least six carbon atoms and a solubility in water of less than about 2; and (c) an alcohol or ketone each having at least six carbon atoms and a solubility in water of less than about 2.

2. The recording element of claim 1, wherein the upper limit of the carbon atom for said alcohol or ketone is about 20.

3. The recording element of claim 2, wherein said carbon atoms range from about 7 to about 16.

4. The recording element of claim 1, wherein said alcohol or ketone is selected from heptanol, octanol, nonanol, decanol, dodecanol, tridecanol, tetradecanol, heptanone, octanone, nonanone and decanone.

5. The recording element of claim 1, wherein said color former is selected from triarylmethane type compounds, diphenylmethane type compounds, xanthene type compounds, thiazine type compounds and spiropyran type compounds.

6. The recording element of claim 5, wherein said color former is crystal violet lactone.

7. The recording element of claim 1, wherein said alcohol or ketone is present in said microcapsules in an amount of 5 to about 50 weight% based on the solvent for the color former in said microcapsules.

8. The recording element of claim 1, wherein said color developer is an organic acid.

9. The recording element of claim 1, wherein said color developer is a polyvalent metal salt of an aromatic carboxylic acid.

10. In a method for forming a color image using a recording element comprising a support having thereon microcapsules containing (a) a color former capable of forming a color on contact with a color developer and (b) a solvent for the color former, the rupturing of which microcapsules allows contact of said color former with said color developer, the improvement comprising said solvent for the color former being other than an alcohol or a ketone, each having at least six carbon atoms and a solubility in water of less than about 2 and the improvement additionally comprising forming said color image more rapidly by incorporating (c) an alcohol or a ketone, each having at least six carbon atoms and a solubility in water of less than about 2, into said microcapsules, with the contents of said microcapsules consisting essentially of said color former (a), said solvent (b) and said alcohol or ketone (c).

* * * * *